US008091152B1

(12) United States Patent
Rucker et al.

(10) Patent No.: US 8,091,152 B1
(45) Date of Patent: Jan. 10, 2012

(54) CUSTOM-FIT TOILET SEAT AND ASSOCIATED METHOD

(76) Inventors: Derick Rucker, Los Angeles, CA (US); Gloria Crump, Los Angeles, CA (US)

( * ) Notice: Subject to any disclaimer, the term of this patent is extended or adjusted under 35 U.S.C. 154(b) by 945 days.

(21) Appl. No.: 12/082,228

(22) Filed: Apr. 9, 2008

(51) Int. Cl.
*A47K 13/00* (2006.01)

(52) U.S. Cl. ..... 4/234

(58) Field of Classification Search ..... 4/234–241
See application file for complete search history.

(56) References Cited

U.S. PATENT DOCUMENTS

| | | | | | |
|---|---|---|---|---|---|
| 3,086,223 | A | * | 4/1963 | Gass | 4/237 |
| 3,209,376 | A | * | 10/1965 | Drury, Jr. | 4/254 |
| 3,364,505 | A | * | 1/1968 | Palmier | 4/239 |
| 3,490,082 | A | * | 1/1970 | Murcott | 4/239 |
| 3,566,421 | A | * | 3/1971 | Waddle | 4/237 |
| 3,593,349 | A | | 7/1971 | Bungo | |
| 3,646,620 | A | * | 3/1972 | McCawley | 4/237 |
| 4,060,859 | A | * | 12/1977 | Anderson | 4/307 |
| 4,181,988 | A | | 1/1980 | Skaggs | |
| 4,578,829 | A | * | 4/1986 | Lenosky | 4/237 |
| 4,747,167 | A | * | 5/1988 | Adams | 4/234 |
| 5,191,660 | A | * | 3/1993 | Francke | 4/239 |
| 5,212,840 | A | * | 5/1993 | Caldwell | 4/237 |
| 5,347,662 | A | * | 9/1994 | Carper-White | 4/237 |
| 5,361,425 | A | * | 11/1994 | Armanno, Sr. | 4/248 |
| 5,414,875 | A | * | 5/1995 | Kappl et al. | 4/236 |
| 6,154,892 | A | | 12/2000 | Hogue | |
| 2007/0294811 | A1 | * | 12/2007 | Todokoro | 4/237 |

* cited by examiner

*Primary Examiner* — David Purol

(57) ABSTRACT

A toilet seat for maintaining a stable engagement with an existing toilet base includes a body suitably sized and shaped for conforming to a top rim of the existing toilet base. The seat includes an outer flange statically coupled to a bottom surface of the body and extending downwardly therefrom. The seat further includes first and second inner flanges adjustably coupled to the body and juxtaposed adjacent to the outer flange. Further, each of the first and second inner flanges include a rubber pad directly attached thereto in such a manner that the rubber pads frictionally engage the inner surface of the existing toilet base top rim. The flanges further include first and second deformably resilient spring members which have a corresponding top end anchored to a curvilinear inner face of the first and second notches respectively.

13 Claims, 9 Drawing Sheets

CUSTOM-FIT TOILET SEAT AND ASSOCIATED METHOD

CROSS REFERENCE TO RELATED APPLICATIONS

This application claims the benefit of U.S. Provisional Application No. 60/921,084, filed Apr. 2, 2007, the entire disclosures of which are incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to toilet seats and, more particularly, to a non-sliding toilet seat assembly for preventing the seat assembly from moving during use.

2. Prior Art

The use of toilet seats are well known in the prior art. Generally, toilet seats consist of a seat member and a lid member that are pivotally connected to the top edge of a toilet's bowl portion. As such, the seat portion rests atop the bowl's top edge when it is in a lowered state, and the lid portion can be lowered thereupon to effectively cover the opening within the seat portion. Although this has been the accepted practice for providing a toilet with a seat and lid, the design has one significant disadvantage. At times, a person sitting on the seat portion while using the restroom may shift their weight. Such a weight shift causes the seat portion to slide from side to side on the bowl's top edge. Over time, the side to side sliding causes the seat portion's hinge connection to be loosened. Thus a user must occasionally retighten the screws of the hinge, but in worst case scenarios, if the loosening is not corrected a person may fall off of the toilet when they shift their weight on a loose toilet seat portion.

U.S. Pat. No. 3,593,349 to Bungo discloses an improved toilet seat for stopping the sounds during a bowel movement, the device comprises a toilet seat with an acoustical liner therebetween and the top of the ceramic commode; and the liner being possibly deodorant impregnated. Unfortunately, this prior art example does not secure the toilet seat in place to prevent the seat from moving during use.

U.S. Pat. No. 4,181,988 to Skaggs discloses an adjustable size toilet seat which has a primary seat and an auxiliary seat structure which is relatively adjustable to reduce the effective seat opening. The primary seat includes longitudinally extending but laterally spaced side elements having inwardly facing longitudinal edges defining a fixed opening. The auxiliary seat structure includes longitudinally extending and laterally spaced seat elements which are carried by said primary seat for transverse movement relative to each other in adjusting the effective size of the seat opening. Each of the auxiliary seat elements have inwardly facing, longitudinally extending edges which are of the same configuration as the edges of the primary seat and are selectively displaceable from a position underlying a respective side element of the primary seat to a relatively inward position defining a reduced size seat opening. Unfortunately, this prior art example does not secure the toilet seat in place to prevent the seat from moving during use.

U.S. Pat. No. 6,154,892 to Hogue discloses a toilet seat and lid, each comprising a rigid insert injection molded of reinforced thermoplastic material. Each insert is then over-molded by injection molding with a thermoplastic elastomeric material which provides the outer surface of seat and lid. The inserts are dimensioned with respect to their over-molded surfaces to be smaller than the finished seat and lid and are designed to give maximum strength to the seat and lid. Each insert is shaped to promote the flow of the over-mold material and to minimize shrinking, swelling or distortion of the insert. The elastomeric material is preferably chemically compatible with the inserts to allow a chemical as well as mechanical bond to take place. The over-molded material provides the desired soft, non-slip, warm to the touch outer characteristics of the seat and lid. Unfortunately, this prior art example does not secure the toilet seat in place to prevent the seat from moving during use.

Accordingly, a need remains for a non-sliding toilet seat assembly in order to overcome the above-noted shortcomings. The present invention satisfies such a need by providing an assembly that is convenient and easy to use, is durable yet lightweight in design, and designed for preventing the seat assembly from moving during use. The assembly is simple to use, inexpensive, and designed for many years of repeated use.

BRIEF SUMMARY OF THE INVENTION

In view of the foregoing background, it is therefore an object of the present invention to provide an apparatus for preventing the seat assembly from moving during use. These and other objects, features, and advantages of the invention are provided by a custom-fit toilet seat for maintaining a stable engagement with an existing toilet base, such a toilet seat. Such a toilet seat preferably includes a body suitably sized and shaped for conforming to a top rim of the existing toilet base. Such toilet seat may further include a lid pivotally coupled to the body.

Such a toilet seat conveniently includes an outer flange statically coupled to a bottom surface of the body and extending downwardly therefrom. Such an outer flange has a single and unitary non-linear shape partially extending along an arcuate outer perimeter of the body. Further, such an outer flange has an L-shaped cross-section including a horizontally oriented first segment and a vertically oriented second segment. The first segment is monolithically formed with the second segment and configured in such a manner that the second segment is disposed exterior of the existing toilet base top rim, while the first segment is intercalated between the body and the existing toilet base top rim respectively.

Such a seat further includes first and second inner flanges adjustably coupled to the body and juxtaposed adjacent to the outer flange in such a manner that such first and second inner flanges remain diametrically spaced apart at opposite sides of the outer flange, while positioned at the top rim of the existing toilet base. A first and second inner flange pivoting mechanism conveniently includes first and second notches formed in the body and extending upwardly from a bottom surface thereof respectively.

Each of the first and second notches terminates subjacent to a top surface of the body and has a curvilinear inner face arcing downwardly and inwardly from respective upper shoulders of the first and second notches. Such a pivoting mechanism advantageously provides for resiliently pivoting the first and second inner flanges about respective fulcrum axes defined parallel to the bottom surface of the body such that the first and second inner flanges independently exert a corresponding frictional force against an inner surface of the top rim.

Further, each of the first and second inner flanges includes a rubber pad directly attached thereto in such a manner that the rubber pads effectively frictionally engage the inner surface of the existing toilet base top rim. Such first and second inner flanges are articulated along mutually exclusive arcuate paths such that the first and second inner flanges are selectively engaged with the inner surface of the existing toilet base top rim and thereby prevent the body from transversely gliding therealong.

The flanges further include first and second deformably resilient spring members which have a corresponding top end anchored to a curvilinear inner face of the first and second notches respectively. Such first and second spring members are conveniently positioned adjacent to the shoulders respectively, such first and second spring members further have a respective bottom end anchored to a corresponding one of the first and second inner flanges. Further, such first and second spring members are independently adapted between equilibrium and expanded positions defined along a linear path registered orthogonal to the fulcrum axis of the first and second inner flanges. Such first and second spring members are disposed at the expanded position when the first and second inner flanges are disengaged from the inner surface of the existing toilet base top rim respectively.

The present invention further provides a method for preventing a toilet seat from transversely gliding along an existing toilet base includes the steps of: providing a body suitably sized and shaped for conforming to a top rim of the existing toilet base; providing and statically coupling an outer flange to a bottom surface of the body such that the outer flange extends downwardly therefrom; providing and adjustably coupling first and second inner flanges to the body by juxtaposing the first and second inner flanges adjacent to the outer flange, in such a manner that the first and second inner flanges remain diametrically spaced apart at opposite sides of the outer flange, while positioned at the top rim of the existing toilet base; and resiliently pivoting the first and second inner flanges about the respective fulcrum axes defined parallel to the bottom surface of the body, such that the first and second inner flanges independently exert a corresponding frictional force against an inner surface of the top rim.

The method may further include the steps of: providing first and second notches formed in the body and extending upwardly from a bottom surface thereof respectively, each of the first and second notches terminating subjacent to a top surface of the body and has a curvilinear inner face arcing downwardly and inwardly from respective upper shoulders of the first and second notches; providing first and second deformably resilient spring members; anchoring a corresponding top end of the first and second spring members to a curvilinear inner face of the first and second notches by positioning the first and second spring members adjacent to the shoulders respectively; anchoring a respective bottom end of each of the first and second spring members to a corresponding one of the first and second inner flanges; articulating the first and second inner flanges along mutually exclusive arcuate paths; and selectively engaging the first and second inner flanges with the inner surface of the existing toilet base top rim and thereby preventing the body from transversely gliding therealong.

The method may further include the steps of: independently adapting the first and second spring members between equilibrium and expanded positions defined along a linear path registered orthogonal to the fulcrum axis of the first and second inner flanges; and disposing the first and second spring members at the expanded position by disengaging the first and second inner flanges from the inner surface of the existing toilet base top rim respectively.

The method may further include the steps of: providing a plurality of rubber pads; attaching the rubber pads directly to the first and second inner flanges; and frictionally engaging the rubber pads with the inner surface of the existing toilet base top rim.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
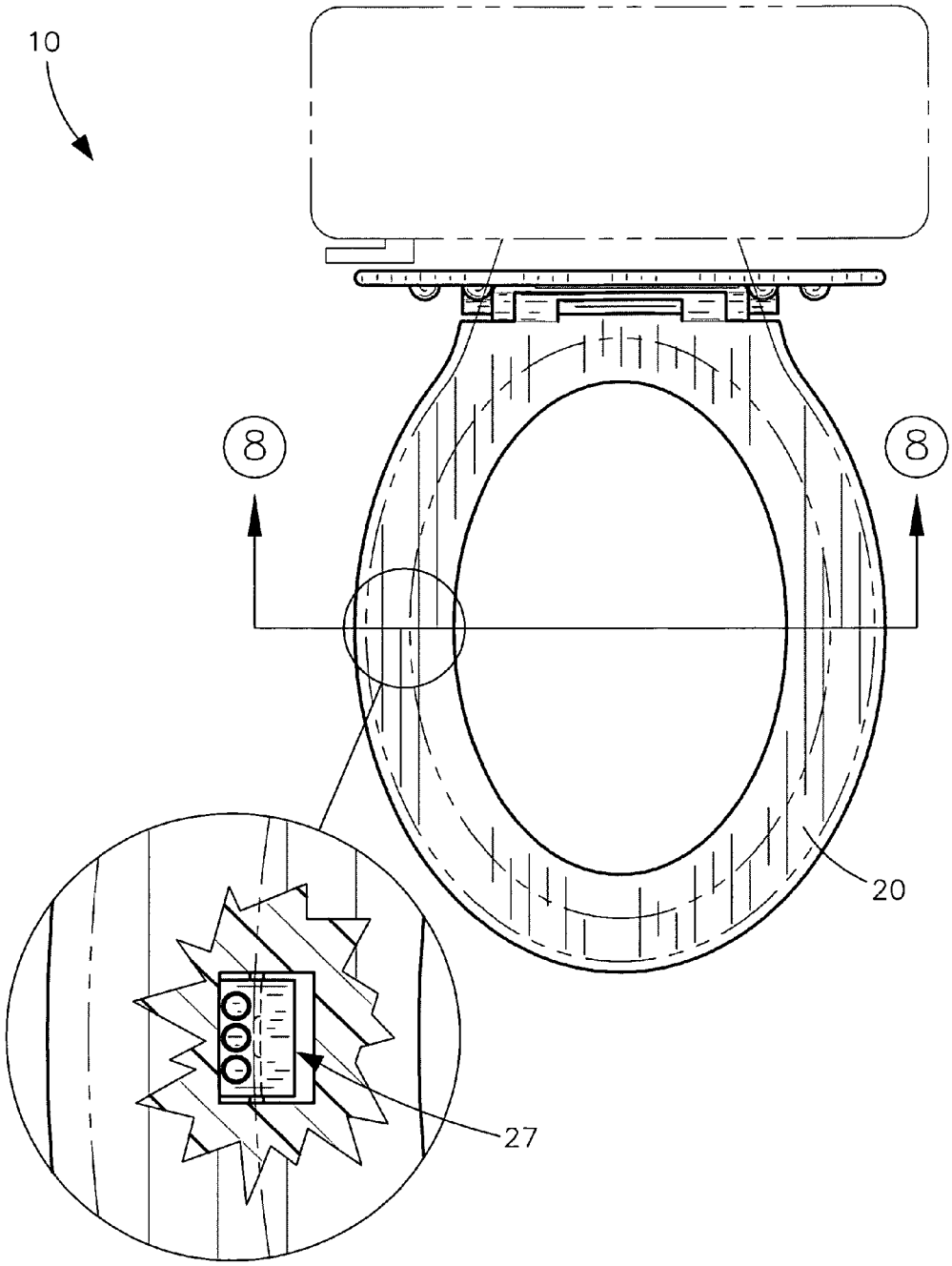
FIG. 1 is a top plan view showing a toilet seat assembly with an enlarged broken view of one of the inner flange pivoting mechanisms.
Figure 2:
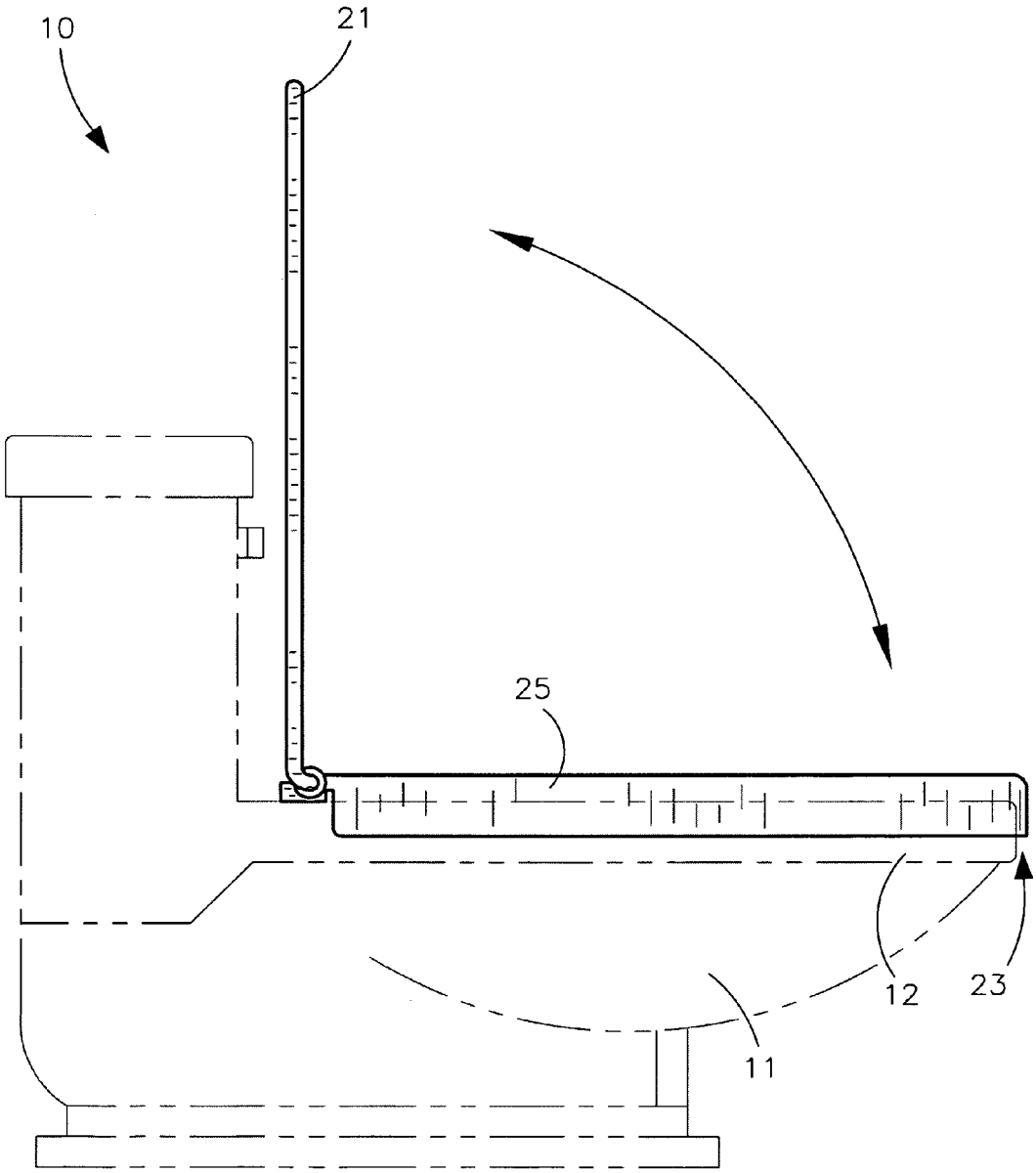
FIGS. 2-3 respectively show side and front elevational views of FIG. 1 with a lid adapted to an open position.
Figure 3:
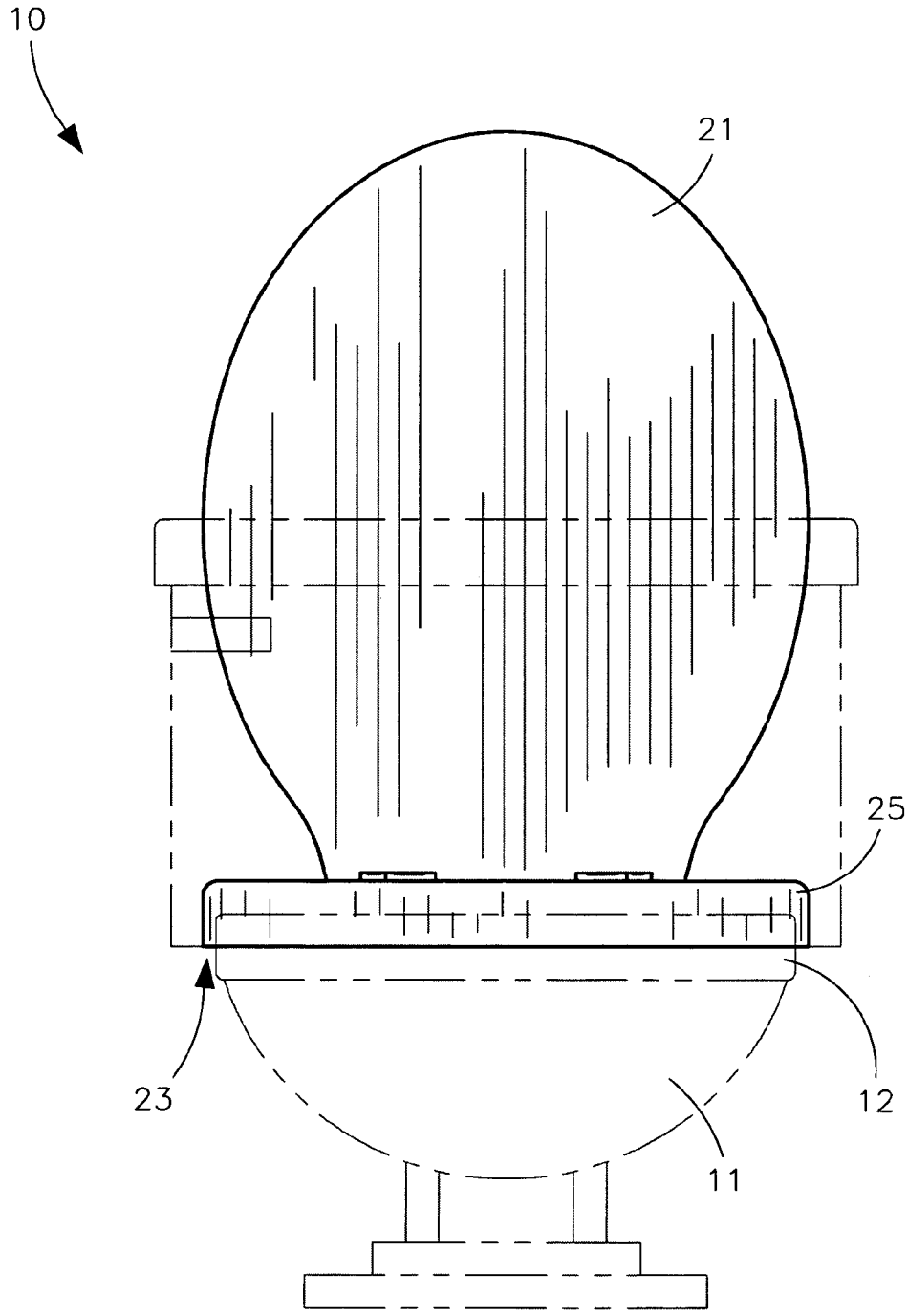
Figure 4:
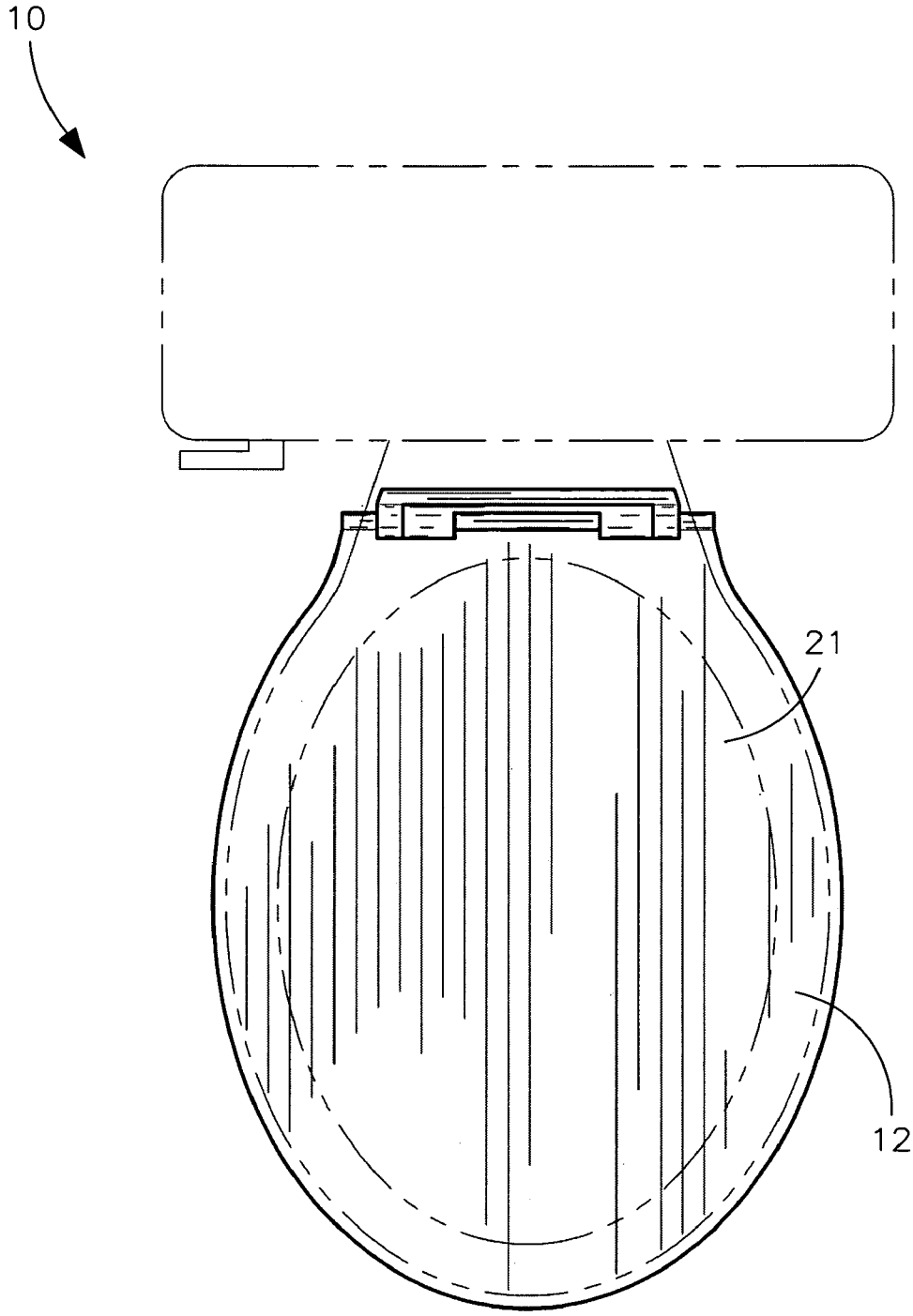
FIGS. 4-6 respectively show top, side and front elevational views of FIG. 1 with the lid adapted to an open position.
Figure 5:
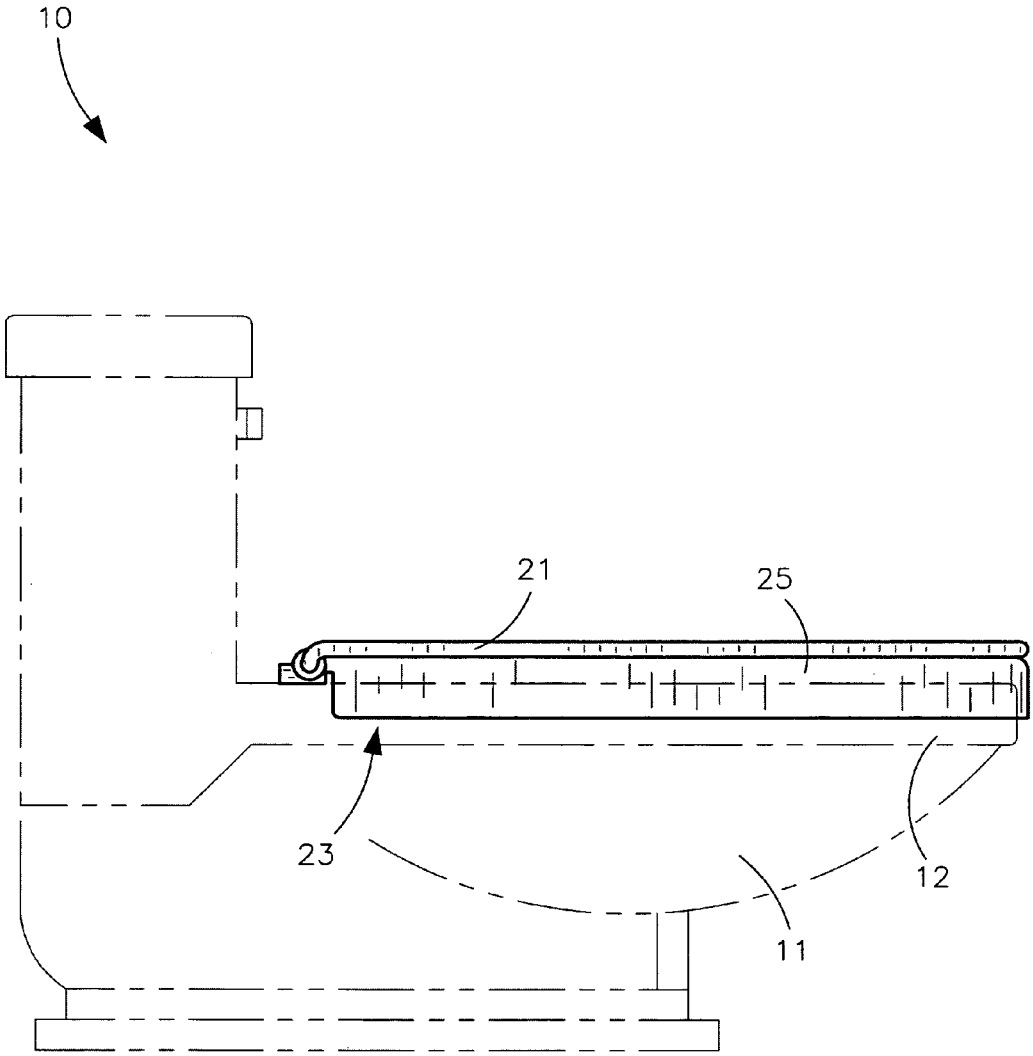
Figure 6:
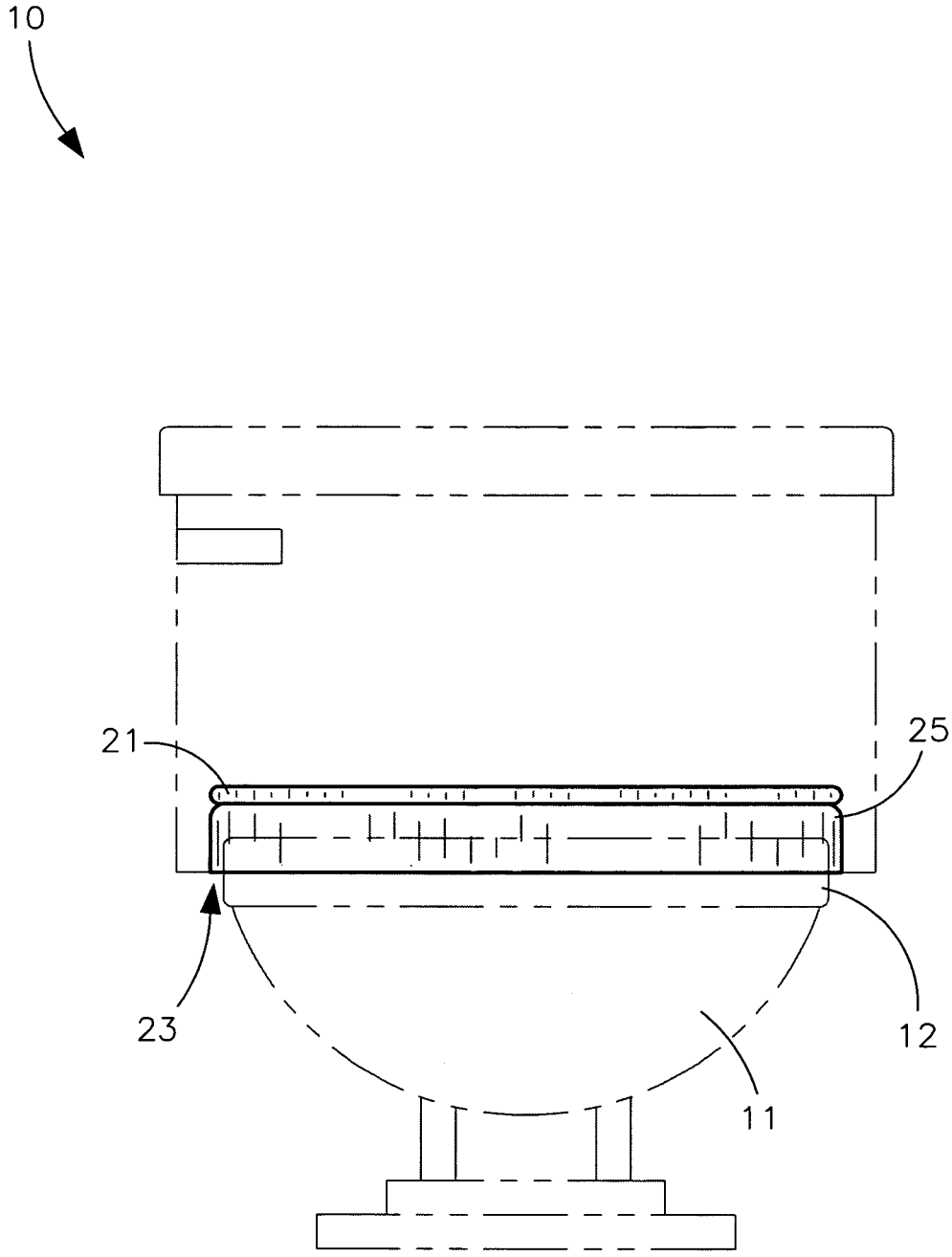
Figure 7:
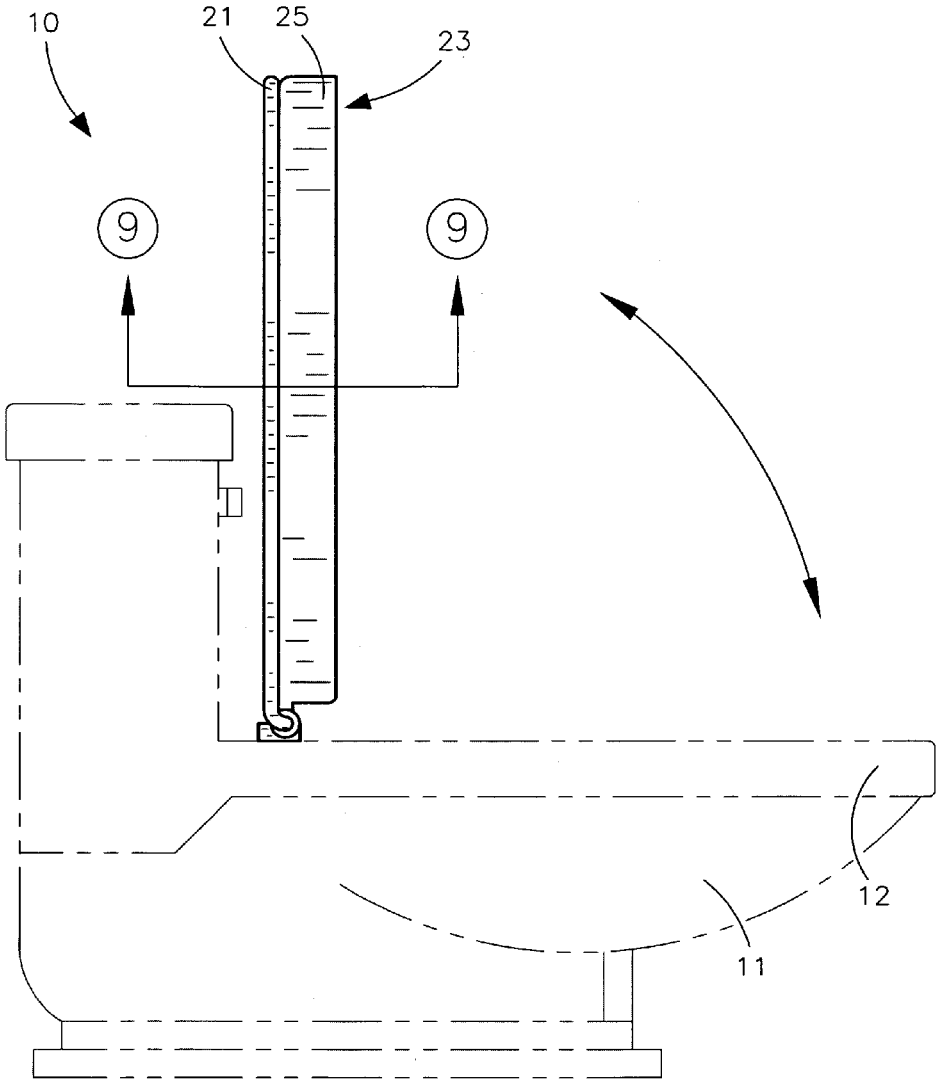
FIG. 7 is side elevational view showing the lid and toilet seat adapted to the open position.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The toilet seat assembly of this invention is referred to generally in FIGS. 1-9 by the reference numeral 10 and is intended to provide a non-sliding toilet seat. It should be understood that the assembly 10 may be used to provide a non-sliding toilet seat 20 for many different types of toilet bowls and should not be limited in use to only one specific model of toilet seats.

Referring initially to FIGS. 1-7, a toilet seat 20 for maintaining a stable engagement with an existing toilet base 11, such a toilet seat 20 includes a body 22 suitably sized and shaped for conforming to a top rim 12 of the existing toilet base 11. Such a toilet seat 20 further includes a lid 21 pivotally coupled to the body.

The seat 20 includes an outer flange 23 statically coupled to a bottom surface of the body 22 and extending downwardly therefrom. Such an outer flange 23 has a single and unitary non-linear shape partially extending along an arcuate outer perimeter of the body 22. Further, such outer flange 23 has an L-shaped cross-section including a horizontally oriented first segment 24 and a vertically oriented second segment 25. The first segment 24 is monolithically formed with the second segment 25 and configured in such a manner that the second segment 25 is disposed exterior of the existing toilet base 11 top rim 12, while the first segment 24 is intercalated between the body 22 and the existing toilet base 11 top rim 12 respectively.

Figure 8:
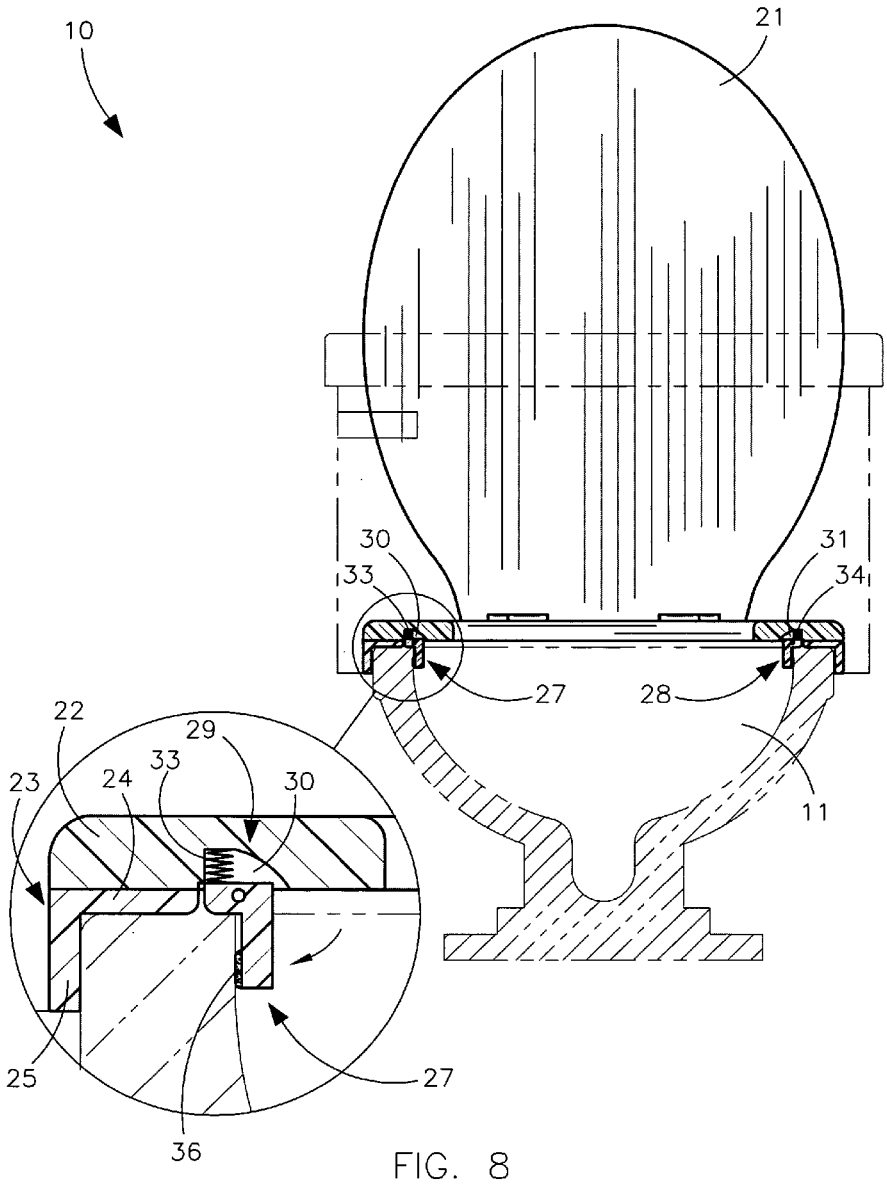
FIG. 8 is a cross-sectional view of FIG. 3 with an enlarged view showing the inner flange pivoting mechanism, in accordance with the present invention.
Figure 9:
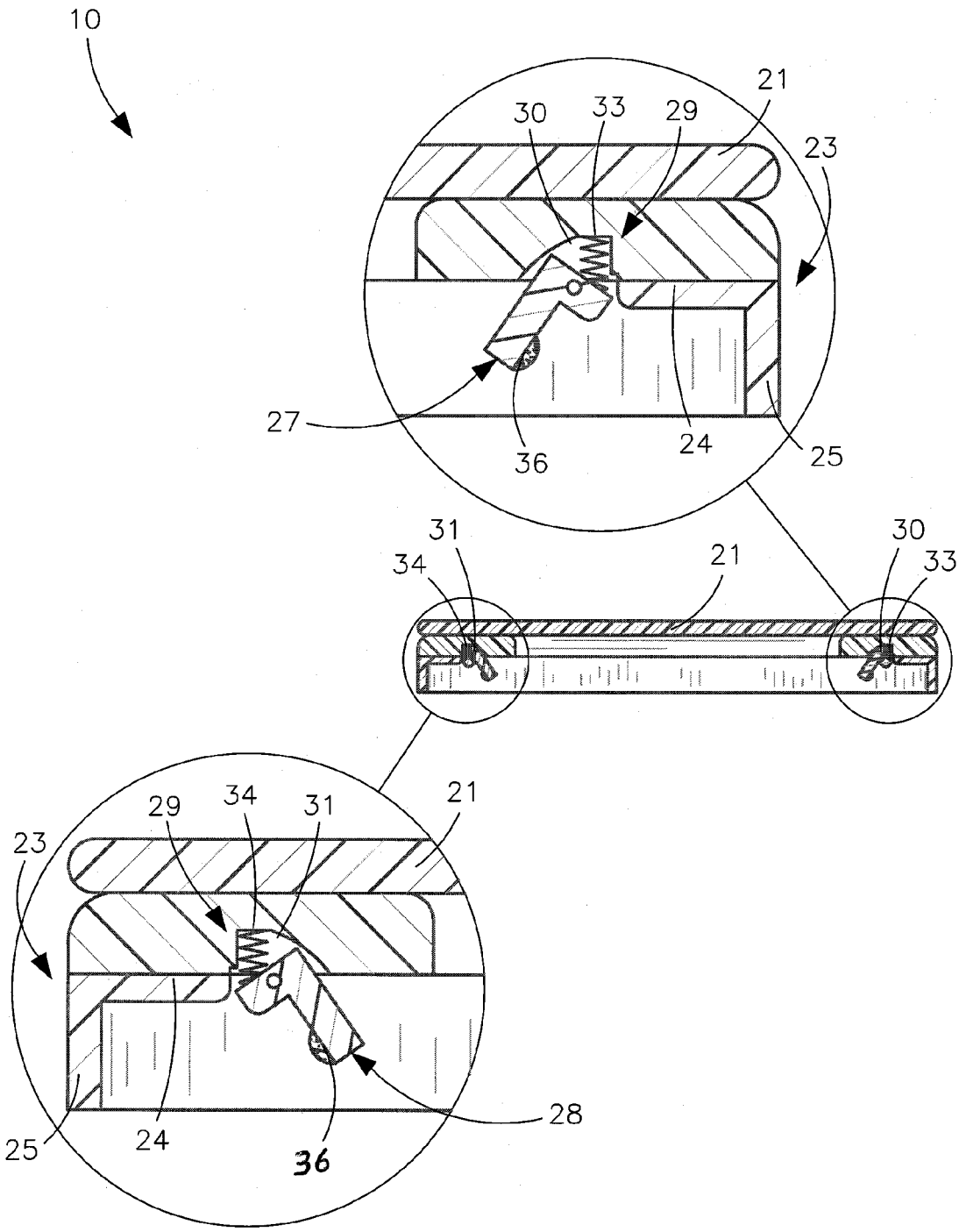
FIG. 9 is an enlarged view of the pivoting mechanism shown in FIG. 8 with the inner flange adapted to an non-equilibrium position.

Referring to FIGS. 8 and 9, the assembly 10 further includes first and second inner flanges 27, 28 adjustably coupled to the body 22 and juxtaposed adjacent to the outer flange 23 in such a manner that such first and second inner flanges 27, 28 remain diametrically spaced apart at opposite sides of the outer flange 23, while positioned at the top rim 12 of the existing toilet base 11. The first and second inner flange pivoting mechanism 29 includes first and second notches 30, 31 formed in the body 22 and extending upwardly from a bottom surface thereof respectively.

Each of the first and second notches 30, 31 terminates subjacent to a top surface of the body 22 and has a curvilinear inner face arcing downwardly and inwardly from respective upper shoulders of the first and second notches 30, 31. Such a pivoting mechanism 29 provides for resiliently pivoting the first and second inner flanges 27, 28 about respective fulcrum axes defined parallel to the bottom surface of the body 22 which is essential such that the first and second inner flanges 27, 28 independently exert a corresponding frictional force against an inner surface of the top rim 12.

Further, each of the first and second inner flanges 27, 28 includes a rubber pad 36 directly attached, without the use of intervening elements, thereto in such a manner that the rubber pads 36 frictionally engage the inner surface of the existing toilet base top rim 12. Such first and second inner flanges 27, 28 are articulated along mutually exclusive arcuate paths, which is vital such that the first and second inner flanges 27, 28 are selectively engaged with the inner surface of the existing toilet base top rim 12 and thereby prevent the body 22 from transversely gliding therealong.

Referring to FIGS. 8 and 9, the assembly 10 further includes first and second deformably resilient spring members 33, 34 which have a corresponding top end anchored to a curvilinear inner face of the first and second notches 30, 31 respectively. Such first and second spring members 33, 34 are positioned adjacent to the shoulders respectively, such first and second spring members 33, 34 further have a respective bottom end anchored to a corresponding one of the first and second inner flanges 27, 28. Further, such first and second spring members 33, 34 are independently adapted between equilibrium and expanded positions defined along a linear path registered orthogonal to the fulcrum axis of the first and second inner flanges 27, 28. Such first and second spring members 33, 34 are disposed at the expanded position when the first and second inner flanges 27, 28 are disengaged from the inner surface of the existing toilet base 22 top rim 12 respectively.

In use, the assembly includes a toilet seat that is suitably sized and shaped to snugly fit over the top edge of the toilet bowl, which is essential and advantageous for preventing the seat from moving during use. In this manner, the wear and tear to the seat's installation hardware is effectively eliminated, which is critical for greatly extending the life of the seat while facilitating user comfort. The seat 20 is effectively secured to the top edge of the bowl by durable inner and outer flanges that extend downward from a bottom surface of the seat. Such inner and outer flanges extend along the entire outer perimeter of the seat and selected portions of the inner perimeter, respectively.

The flanges can measure any at any diameter that effectively bridges the distance between the seat and the top edge of the bowl. This feature is vital for more evenly distributing the weight of the user and taking the pressure off of the moveable hinges and non moveable bolts. Of course, the seat assembly 10 could be manufactured in a variety of colors and hues, as is obvious to a person of ordinary skill in the art. Of course, padded versions of the seat could also be produced, as is obvious to a person of ordinary skill in the art.

The present invention, as claimed, provides the unexpected and unpredictable benefit of a toilet seat assembly that is convenient and easy to use, is durable yet lightweight in design, and provides a sturdy and comfortable alternative to traditional toilet seats. As a fully functioning toilet seat featuring an integrated flange support system which takes the pressure of the user off the installation hardware, evenly distributing it across the surface of the seat, the present invention can withstand repeated use and still remain sturdily installed atop the bowl.

The assembly effectively protects the hinges and threaded bolts used to secure the seat to the bowl from becoming loose, frayed, cracked or broken, regardless of the weight of the user or the frequency of use. This advantage proves particularly beneficial to obese users who are often faced with frustration and high costs associated with constantly replacing toilet seats, simply because the installation hardware has broken. By placing the assembly down before flushing, it eliminates harmful bacteria from becoming airborne. The non-sliding toilet seat assembly is airtight, thus keeping any bacteria inside of the bowl, where they can easily be eliminated with sanitizers.

In use, a method for preventing a toilet seat from transversely gliding along an existing toilet base 11 includes the steps of: providing a body suitably sized and shaped for conforming to a top rim 12 of the existing toilet base 11; providing and statically coupling an outer flange 23 to a bottom surface of the body such that the outer flange 23 extends downwardly therefrom; providing and adjustably coupling first and second inner flanges 27, 28 to the body by juxtaposing the first and second inner flanges 27, 28 adjacent to the outer flange 23, in such a manner that the first and second inner flanges 27, 28 remain diametrically spaced apart at opposite sides of the outer flange 23, while positioned at the top rim 12 of the existing toilet base 11; and resiliently pivoting the first and second inner flanges 27, 28 about the respective fulcrum axes defined parallel to the bottom surface of the body, such that the first and second inner flanges 27, 28 independently exert a corresponding frictional force against an inner surface of the top rim 12.

In use, the method may further include the steps of: providing first and second notches 30, 31 formed in the body and extending upwardly from a bottom surface thereof respectively, each of the first and second notches 30, 31 terminating subjacent to a top surface of the body and has a curvilinear inner face arcing downwardly and inwardly from respective upper shoulders of the first and second notches 30, 31; providing first and second deformably resilient spring members 33, 34; anchoring a corresponding top end of the first and second spring members 33, 34 to a curvilinear inner face of the first and second notches 30, 31 by positioning the first and second spring members 33, 34 adjacent to the shoulders respectively; anchoring a respective bottom end of each of the first and second spring members 33, 34 to a corresponding one of the first and second inner flanges 27, 28; articulating the first and second inner flanges 27, 28 along mutually exclusive arcuate paths; and selectively engaging the first and second inner flanges 27, 28 with the inner surface of the existing toilet base 11 top rim 12 and thereby preventing the body from transversely gliding therealong.

In use, the method may further include the steps of: independently adapting the first and second spring members 33, 34 between equilibrium and expanded positions defined along a linear path registered orthogonal to the fulcrum axis of the first and second inner flanges 27, 28; and disposing the first and second spring members 33, 34 at the expanded position by disengaging the first and second inner flanges 27, 28 from the inner surface of the existing toilet base 11 top rim 12 respectively.

In use, the method may further include the steps of: providing a plurality of rubber pads 36; attaching the rubber pads 36 directly to the first and second inner flanges 27, 28; and frictionally engaging the rubber pads 36 with the inner surface of the existing toilet base 11 top rim 12.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A toilet seat for maintaining a stable engagement with an existing toilet base, said toilet seat comprising:

a body suitably sized and shaped for conforming to a top rim of the existing toilet base;

an outer flange statically coupled to a bottom surface of said body and extending downwardly therefrom;

first and second inner flanges adjustably coupled to said body and juxtaposed adjacent to said outer flange in such a manner that said first and second inner flanges remain diametrically spaced apart at opposite sides of said outer flange while positioned at the top rim of the existing toilet base; and means for resiliently pivoting said first and second inner flanges about respective fulcrum axes defined parallel to said bottom surface of said body such that said first and second inner flanges independently exert a corresponding frictional force against an inner surface of the top rim;

wherein said first and second inner flange pivoting means comprises:

first and second notches formed in said body and extending upwardly from a bottom surface thereof respectively, each of said first and second notches terminating subjacent to a top surface of said body and having a curvilinear inner face arcing downwardly and inwardly from respective upper shoulders of said first and second notches; and first and second deformably resilient spring members having a corresponding top end anchored to a curvilinear inner face of said first and second notches respectively, said first and second spring members being positioned adjacent to said shoulders respectively, said first and second spring members further having a respective bottom end anchored to a corresponding one of said first and second inner flanges;

wherein said first and second inner flanges are articulated along mutually exclusive arcuate paths such that said first and second inner flanges are selectively engaged with the inner surface of the existing toilet base top rim and thereby prevent said body from transversely gliding therealong.

2. The toilet seat of claim 1, wherein said outer flange has a single and unitary non-linear shape partially extending along an arcuate outer perimeter of said body.

3. The toilet seat of claim 1, wherein said outer flange has an L-shaped cross-section comprising: a horizontally oriented first segment and a vertically oriented second segment, said first segment being monolithically formed with said second segment and configured in such a manner that said second segment is disposed exterior of the existing toilet base top rim while said first segment is intercalated between said body and the existing toilet base top rim respectively.

4. The toilet seat of claim 1, wherein said first and second spring members are independently adapted between equilibrium and expanded positions defined along a linear path registered orthogonal to the fulcrum axis of said first and second inner flanges, said first and second spring members being disposed at the expanded position when said first and second inner flanges are disengaged from the inner surface of the existing toilet base top rim respectively.

5. The toilet seat of claim 1, wherein each of said first and second inner flanges comprise: a rubber pad directly attached thereto in such a manner that said rubber pads frictionally engage the inner surface of the existing toilet base top rim.

6. A toilet seat for maintaining a stable engagement with an existing toilet base, said toilet seat comprising:

a body suitably sized and shaped for conforming to a top rim of the existing toilet base;

a lid pivotally coupled to said body;

an outer flange statically coupled to a bottom surface of said body and extending downwardly therefrom;

first and second inner flanges adjustably coupled to said body and juxtaposed adjacent to said outer flange in such a manner that said first and second inner flanges remain diametrically spaced apart at opposite sides of said outer flange while positioned at the top rim of the existing toilet base; and means for resiliently pivoting said first and second inner flanges about respective fulcrum axes defined parallel to said bottom surface of said body such that said first and second inner flanges independently exert a corresponding frictional force against an inner surface of the top rim;

wherein said first and second inner flange pivoting means comprises first and second notches formed in said body and extending upwardly from a bottom surface thereof respectively, each of said first and second notches terminating subjacent to a top surface of said body and having a curvilinear inner face arcing downwardly and inwardly from respective upper shoulders of said first and second notches; and first and second deformably resilient spring members having a corresponding top end anchored to a curvilinear inner face of said first and second notches respectively, said first and second spring members being positioned adjacent to said shoulders respectively, said first and second spring members further having a respective bottom end anchored to a corresponding one of said first and second inner flanges;

wherein said first and second inner flanges are articulated along mutually exclusive arcuate paths such that said first and second inner flanges are selectively engaged with the inner surface of the existing toilet base top rim and thereby prevent said body from transversely gliding therealong.

7. The toilet seat of claim 6, wherein said outer flange has a single and unitary non-linear shape partially extending along an arcuate outer perimeter of said body.

8. The toilet seat of claim 6, wherein said outer flange has an L-shaped cross-section comprising: a horizontally oriented first segment and a vertically oriented second segment, said first segment being monolithically formed with said second segment and configured in such a manner that said second segment is disposed exterior of the existing toilet base top rim while said first segment is intercalated between said body and the existing toilet base top rim respectively.

9. The toilet seat of claim 6, wherein said first and second spring members are independently adapted between equilibrium and expanded positions defined along a linear path registered orthogonal to the fulcrum axis of said first and second inner flanges, said first and second spring members being disposed at the expanded position when said first and second inner flanges are disengaged from the inner surface of the existing toilet base top rim respectively.

10. The toilet seat of claim 6, wherein each of said first and second inner flanges comprise: a rubber pad directly attached thereto in such a manner that said rubber pads frictionally engage the inner surface of the existing toilet base top rim.

11. A method for preventing a toilet seat from transversely gliding along an existing toilet base, said method comprising the steps of:

a. providing a body suitably sized and shaped for conforming to a top rim of the existing toilet base;

b. providing and statically coupling an outer flange to a bottom surface of said body such that said outer flange extends downwardly therefrom;

c. providing and adjustably coupling first and second inner flanges to said body by juxtaposing said first and second inner flanges adjacent to said outer flange in such a manner that said first and second inner flanges remain diametrically spaced apart at opposite sides of said outer flange while positioned at the top rim of the existing toilet base; and d. resiliently pivoting said first and second inner flanges about respective fulcrum axes defined parallel to said bottom surface of said body such that said first and second inner flanges independently exert a corresponding frictional force against an inner surface of the top rim;

wherein step d. comprises the steps of:

providing first and second notches formed in said body and extending upwardly from a bottom surface thereof respectively, each of said first and second notches terminating subjacent to a top surface of said body and having a curvilinear inner face arcing downwardly and inwardly from respective upper shoulders of said first and second notches;

providing first and second deformably resilient spring members;

anchoring a corresponding top end of said first and second spring members to a curvilinear inner face of said first and second notches by positioning said first and second spring members adjacent to said shoulders respectively;

anchoring a respective bottom end of each of said first and second spring members to a corresponding one of said first and second inner flanges;

articulating said first and second inner flanges along mutually exclusive arcuate paths; and selectively engaging said first and second inner flanges with the inner surface of the existing toilet base top rim and thereby preventing said body from transversely gliding therealong.

12. The method of claim 11, further comprising the steps of:

independently adapting said first and second spring members between equilibrium and expanded positions defined along a linear path registered orthogonal to the fulcrum axis of said first and second inner flanges; and disposing said first and second spring members at the expanded position by disengaging said first and second inner flanges from the inner surface of the existing toilet base top rim respectively.

13. The method of claim 11, further comprising the steps of:

providing a plurality of rubber pads;

attaching said rubber pads directly to said first and second inner flanges; and frictionally engaging said rubber pads with the inner surface of the existing toilet base top rim.

* * * * *